US009826621B1

(12) United States Patent
Widmann et al.

(10) Patent No.: US 9,826,621 B1
(45) Date of Patent: Nov. 21, 2017

(54) ELECTROMAGNETIC WAVE REFRACTION VIA CONTROLLED PLASMA

(71) Applicants: Peter J. Widmann, Chino Hills, CA (US); Scott R. Sorbel, Redondo Beach, CA (US); Owen Cupp, Fullerton, CA (US); Thomas E. Keavney, Lakewood, CA (US)

(72) Inventors: Peter J. Widmann, Chino Hills, CA (US); Scott R. Sorbel, Redondo Beach, CA (US); Owen Cupp, Fullerton, CA (US); Thomas E. Keavney, Lakewood, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 0 days.

(21) Appl. No.: 15/348,583

(22) Filed: Nov. 10, 2016

(51) Int. Cl.
*H05H 7/00* (2006.01)
*H05H 1/48* (2006.01)

(52) U.S. Cl.
CPC ..... *H05H 7/00* (2013.01); *H05H 1/48* (2013.01)

(58) Field of Classification Search
CPC .... G02B 1/005; G02B 1/007; G02B 27/0087; G02B 26/06; G02B 26/0816; H01Q 15/0066; H01Q 15/14; H01Q 15/148; H01Q 21/0018; H01Q 3/46; H05H 1/46; H01J 11/42; H01J 11/18; H01J 11/22
USPC ..... 250/505.1, 423 R, 424, 515.1, 503.4; 313/582, 231.31, 231.61, 583, 587; 359/240, 245, 263, 290
See application file for complete search history.

(56) References Cited

U.S. PATENT DOCUMENTS 7,255,062 B1 * 8/2007 Higman ..... H05H 1/46 118/723 AN
7,566,889 B1 * 7/2009 Klein ..... G02B 27/0087 250/503.1
7,710,035 B2 * 5/2010 Ryu ..... H01J 11/12 313/112
7,795,816 B2 * 9/2010 Jennings ..... H01L 21/67115 315/111.21
8,299,696 B1 * 10/2012 Wedding ..... H01J 9/241 313/487
8,736,166 B1 * 5/2014 Butcher ..... H01J 11/18 313/582

(Continued)

*Primary Examiner* — David A Vanore
(74) *Attorney, Agent, or Firm* — Tarolli, Sundheim, Covell & Tummino LLP

(57) ABSTRACT

Systems and methods are provided for redirecting electromagnetic radiation around an object. A first assembly, including a first interior wall and a first exterior wall enclosing a propellant gas, substantially encloses the object. A first control system is configured to energize the propellant gas to provide a first volume of plasma and control an electron number density of the first volume of plasma. The electron number density of the first volume of plasma is selected to minimize reflection of the electromagnetic radiation from the first exterior wall. A second assembly includes a second interior wall and a second exterior wall enclosing a propellant gas and is substantially concentric with the first assembly and substantially encloses the object. A second control system is configured to energize the propellant gas to provide a second volume of plasma and control an electron number density of the second volume of plasma.

20 Claims, 3 Drawing Sheets

(56) References Cited

U.S. PATENT DOCUMENTS 8,988,759 B2 * 3/2015 Bowers ..... G02B 1/005
343/909
8,998,668 B1 * 4/2015 Wedding ..... H01J 11/18
445/24

* cited by examiner

ELECTROMAGNETIC WAVE REFRACTION VIA CONTROLLED PLASMA

FIELD OF THE INVENTION

The invention relates generally to optical systems, and more specifically, to systems and methods for electromagnetic wave refraction via controlled plasma.

BACKGROUND OF THE INVENTION

Plasma is an electrically neutral medium of unbound positive and negative particles. It is important to note that although the particles are unbound, they are not 'free' in the sense of not experiencing forces. When a charged particle moves, it generates an electric current with magnetic fields; in plasma, the movement of a charged particle affects and is affected by the general field created by the movement of other charges. This governs collective behavior with many degrees of variation. For plasma to exist, ionization is necessary. The term "plasma density" by itself usually refers to the "electron density", that is, the number of free electrons per unit volume. The degree of ionization of a plasma is the proportion of atoms that have lost or gained electrons, and is controlled mostly by the temperature. Even a partially ionized gas in which as little as one percent of the particles are ionized can have the characteristics of a plasma, such as response to magnetic fields and high electrical conductivity.

SUMMARY OF THE INVENTION

In accordance with an aspect of the present invention, a system is provided for redirecting electromagnetic radiation, having a frequency within a frequency band of interest, around an object of interest. A first assembly includes a first interior wall and a first exterior wall enclosing a propellant gas. The first assembly substantially encloses the object of interest. A first control system is configured to energize the propellant gas within the first assembly to provide a first volume of plasma, such that an electron number density of the first volume of plasma is controlled via the first control system. The electron number density of the first volume of plasma is selected to minimize reflection of the electromagnetic radiation from the first exterior wall. A second assembly includes a second interior wall and a second exterior wall enclosing a propellant gas. The second assembly is positioned as to be substantially concentric with the first assembly and to substantially enclose the object of interest. A second control system is configured to energize the propellant gas within the second assembly to provide a second volume of plasma, such that an electron number density of the second volume of plasma is controlled via the second control system.

In accordance with another aspect of the present invention, a method is provided for redirecting electromagnetic radiation, having a frequency within a frequency band of interest, around an object of interest. A propellant gas within a first assembly, substantially encompassing the object of interest, is energized to provide a first volume of plasma with an electron number density selected to provide a first index of refraction selected to be subunity. A propellant gas within a second assembly, substantially encompassing the object of interest and substantially encompassed by the first assembly, is energized to provide a second volume of plasma with an electron number density selected to provide a second index of refraction that is between seventy-five and ninety-five percent of the first index of refraction.

In accordance with still another aspect of the present invention, a system is provided for redirecting electromagnetic radiation, having a frequency within a frequency band of interest, around an object of interest. A first assembly includes a first interior wall and a first exterior wall enclosing a propellant gas. The first assembly substantially encloses the object of interest. A first control system is configured to energize the propellant gas within the first assembly to provide a first volume of plasma, such that an electron number density of the first volume of plasma is controlled via the first control system. The electron number density of the first volume of plasma is selected to provide a first, subunity index of refraction selected to minimize reflection of the electromagnetic radiation from the first exterior wall. A second assembly includes a second interior wall and a second exterior wall enclosing a propellant gas. The second assembly is positioned as to be substantially concentric with the first assembly and to substantially enclose the object of interest. A second control system is configured to energize the propellant gas within the second assembly to provide a second volume of plasma, such that an electron number density of the second volume of plasma is controlled via the second control system to provide a second index of refraction that is between seventy-five and ninety-five percent of the first index of refraction.

BRIEF DESCRIPTION OF THE DRAWINGS

The features, objects, and advantages of the invention will become more apparent from the detailed description set forth below when taken in conjunction with the drawings, wherein.

DETAILED DESCRIPTION OF THE INVENTION

The index of refraction through plasma depends on the level of ionization of that plasma, which can be controlled. By varying the level of ionization in adjacent containers of plasma, the refraction of electromagnetic waves can be manipulated in useful ways. The inventors have determined systems and methods for refracting electromagnetic radiation, for example, radio frequency (RF) waves, away from an object that would otherwise create undesirable interference. Specifically, by tapering indices of refraction around an object, it is possible to steer electromagnetic waves from that object, preventing undesirable reflections from that object. The resulting system can be used to shield support structures in an antenna test facility, to reduce interference with cell phone transmissions, or to reduce other undesirable effects of metal structures reflecting electromagnetic waves, such as RF transmissions.

Figure 1:
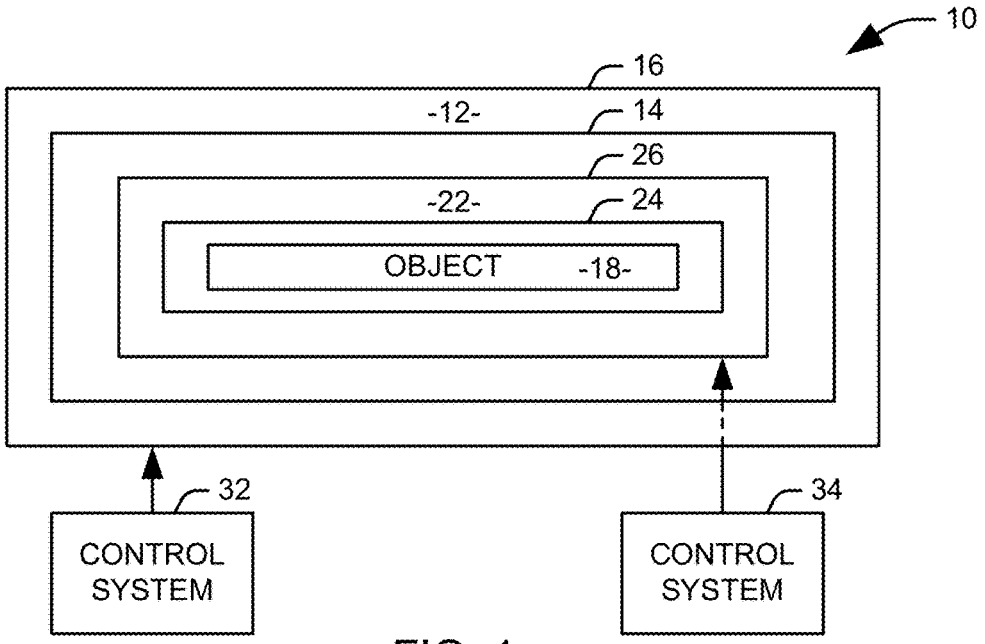
FIG. 1 illustrates a system for redirecting electromagnetic radiation around an object of interest.

FIG. 1 illustrates a system 10 for redirecting electromagnetic radiation around an object of interest 18. The system 10 includes a first assembly 12, comprising a first interior wall 14 and a first exterior wall 16 enclosing a propellant gas. The first assembly 12 is positioned as to substantially enclose the object of interest 18. A second assembly 22, comprising a second interior wall 24 and a second exterior wall 26 enclosing a propellant gas. The second assembly 22 is positioned as to be substantially concentric with the first assembly 12 and to substantially enclose the object of interest 18. While the first assembly 12 and the second assembly 22 are illustrated here as rectangular in cross-section, it will be appreciated that the first and second assemblies can be implemented in any shape that is amendable to fabrication in an appropriate material for containing the propellant gas.

While the first and second assemblies 12 and 22 are illustrated in FIG. 1 as completely separate structures, in one implementation, the structures can have portions in common. For example, the first interior wall 14 and the second exterior wall 26 can represent a common structure shared by the two assemblies 12 and 22. In one implementation, each of the first interior wall 14, the first exterior wall 16, the second interior wall 24, and the second exterior wall 26 can be formed from a dielectric material, such as glass.

A first control system 32 is configured to energize the propellant gas within the first assembly 12 to provide a first volume of plasma and control an electron number density of the first volume of plasma. A second control system 34 is configured to energize the propellant gas within the second assembly 22 to provide a second volume of plasma and control an electron number density of the second volume of plasma. For example, the each control system 32 and 34 can comprise at least a pair of electrodes, with the electron number density of the plasma controlled by varying a current across the electrodes. Since the index of refraction of the plasma is a function of the electron number density, the index of refraction of the plasma in each assembly 12 and 22 can be controlled via the first and second control systems 32 and 34, respectively. It will be noted that the index of refraction of any material, including plasmas, also depends of the frequency of the incoming electromagnetic radiation. Accordingly, one of skill in the art will appreciate that references to an "index of refraction" throughout this application refers to an index of refraction for a frequency or frequency band of interest.

Figure 2:
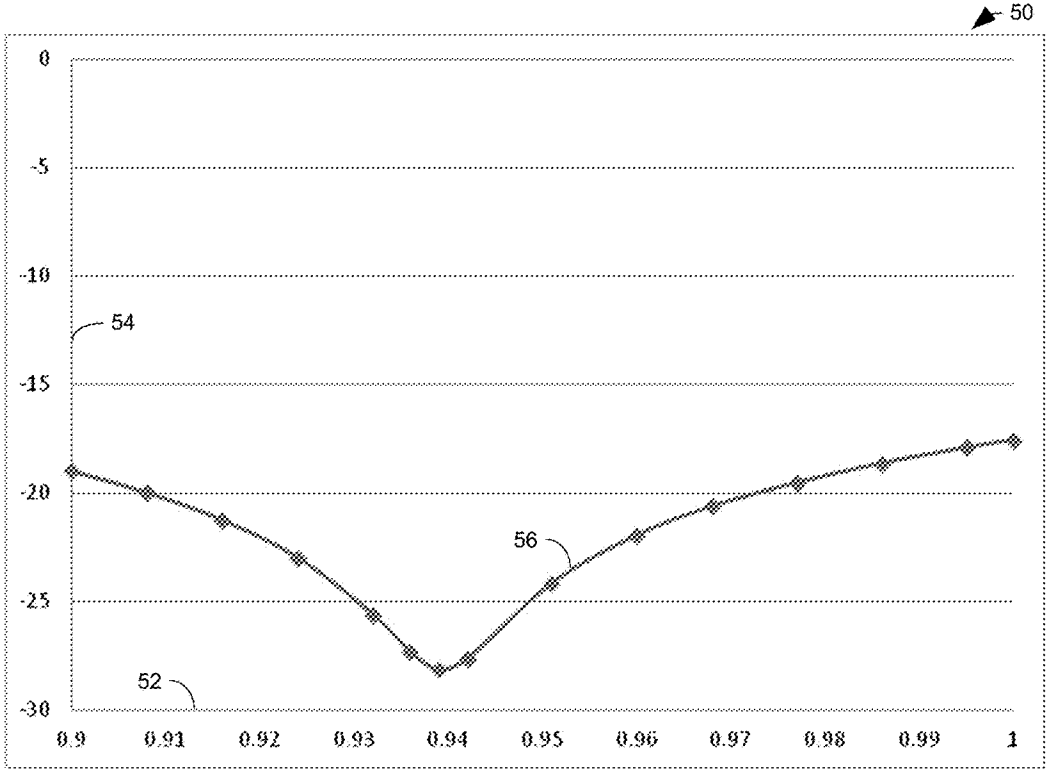
FIG. 2 illustrates a chart of the effects of an index of refraction of the plasma, represented on a horizontal axis, on the reflection of radio frequency electromagnetic radiation, represented on a vertical axis in decibels, for a glass walled container.

The illustrated system 10 utilizes refraction of the electromagnetic radiation to electromagnetic radiation around an object of interest, and thus the electron number density of either or both of the first and second volumes of plasma can be selected to minimize reflection of the electromagnetic radiation from the first and second assemblies 12 and 22. It will be appreciated that by "minimize reflection," it is meant specifically that the electromagnetic energy reflected by to the source of the emission is minimized. FIG. 2 illustrates a chart 50 of the effects of an index of refraction of the plasma, represented on a horizontal axis 52, on the reflection of radio frequency electromagnetic radiation, represented on a vertical axis 54 in decibels, for a glass walled container. It will be appreciated that the measured reflectivity 56 shows a notable decline between indices of refraction of 0.92 and 0.96, with a local minimum at 0.94. Accordingly, by controlling the plasma an outermost of the first assembly 12 and the second assembly to stay within the range, reflection of the exterior wall (e.g., 16) can be minimized.

The inventors have determined that reflected energy from the various assemblies 12 and 14 can be minimized via destructive interference among the reflected radiation. Electromagetic radiation experiences changes in both phase and amplitude traveling through the plasma, and thus each of the thickness and the index of refraction can be tuned to select an amplitude and phase of material reflected from an interior wall of the assembly containing the plasma. By selecting these values carefully, the destructive interference between radiation reflected from each of the inner and outer surfaces can be maximized to reduce the reflected energy. It will be appreciated that the specific value for which reflection is minimized at each assembly can depend on the values selected for previous assemblies, as the changes in phase and amplitude at each previous assembly can impact the desired values at later stages.

Figure 3:
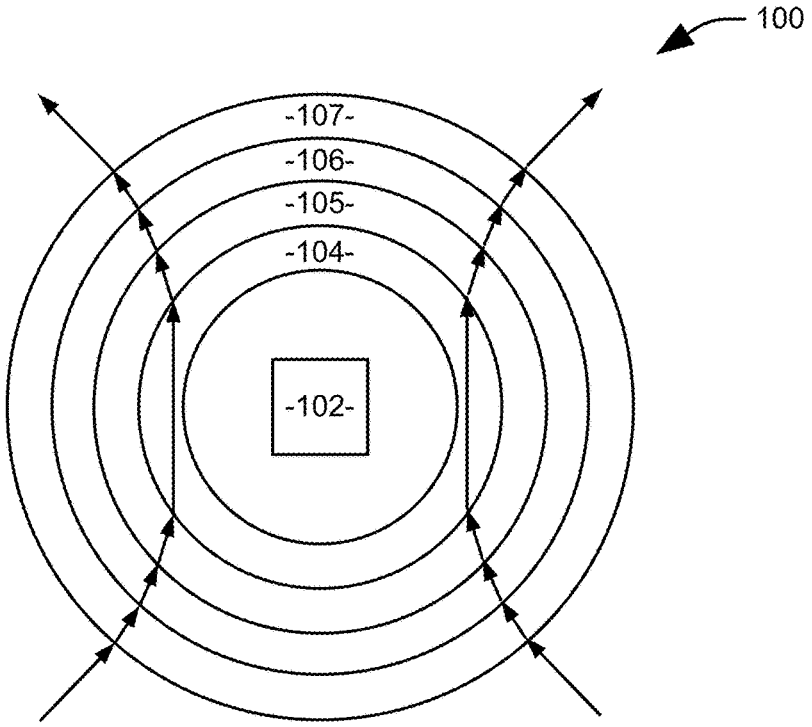
FIG. 3 illustrates one example of a system for redirecting electromagnetic radiation around an object of interest.

FIG. 3 illustrates one example of a system 100 for redirecting electromagnetic radiation around an object of interest 102. The system 100 includes four concentric assemblies 104-107 enclosing propellant gas that can be energized to provide a plasma. In the illustrated implementation, the four assemblies 104-107 are formed as five borosilicate glass walls, each having a thickness of approximately five hundredths of an inch, containing four volumes of propellant gas. Each assembly 104-107 can include at least a pair of electrodes configured to provide a tunable current to the propellant gas as part of a control system (not shown). Accordingly, the gas can be energized such that to provide a desired index of refraction at the frequency band of interest, n, by controlling an electron density of the plasma, $n_e$, such that:

$$n = \sqrt{1 - \frac{n_e e^2}{(f_c^2 + \omega^2)\varepsilon_0 m_e}} \qquad \text{Eq. 1}$$

where e is the electron charge, $m_e$ is the electron mass, $f_c$ is the electron-neutral collision frequency, ω is the frequency of the incident wave, and $\in_0$ is the permittivity of free space.

The inventors have determined that, by tapering the index of refraction of the four assemblies, such that the outermost assembly 107 has a highest index of refraction and the innermost assembly 104 has a lowest index of reflection. It will be appreciated that the propellant gas can be energized to provide the electron number density of the first volume of plasma such that an index of refraction of the first volume of plasma at the frequency band of interest is less than one. In one example, the first and outermost assembly 107 can be energized to have an index of refraction of 0.939, the second assembly 106 can be energized to have an index of refraction of 0.866, the third assembly 105 can be energized to have an index of refraction of 0.781, the fourth and outermost assembly 104 can be energized to have an index of refraction of 0.665. By tapering the values in this manner, it is possible to divert electromagnetic around the object of interest, avoiding reflection of the electromagnetic radiation from the object of interest.

It will be appreciated that the apparatus of FIG. 3 is merely an example, and that the general principles taught herein can be applied to any of a number of layers of plasma. Generally, the index of refraction of an innermost layer of the apparatus will decrease with the number of layers, and can approach zero when a large number of layers are used. In addition to the index of refraction of the plasma within a given layer, the thickness of the layers itself can also be varied to change the optical effect of the layer. In the illustrated implementation, each layer is one inch in thickness, although other thicknesses can be used, with different layers have different thicknesses in some applications. In particular, thicker layers can make the refraction provided by each layer more effective, at the cost of increasing the size and the expense of the apparatus.

Figure 4:
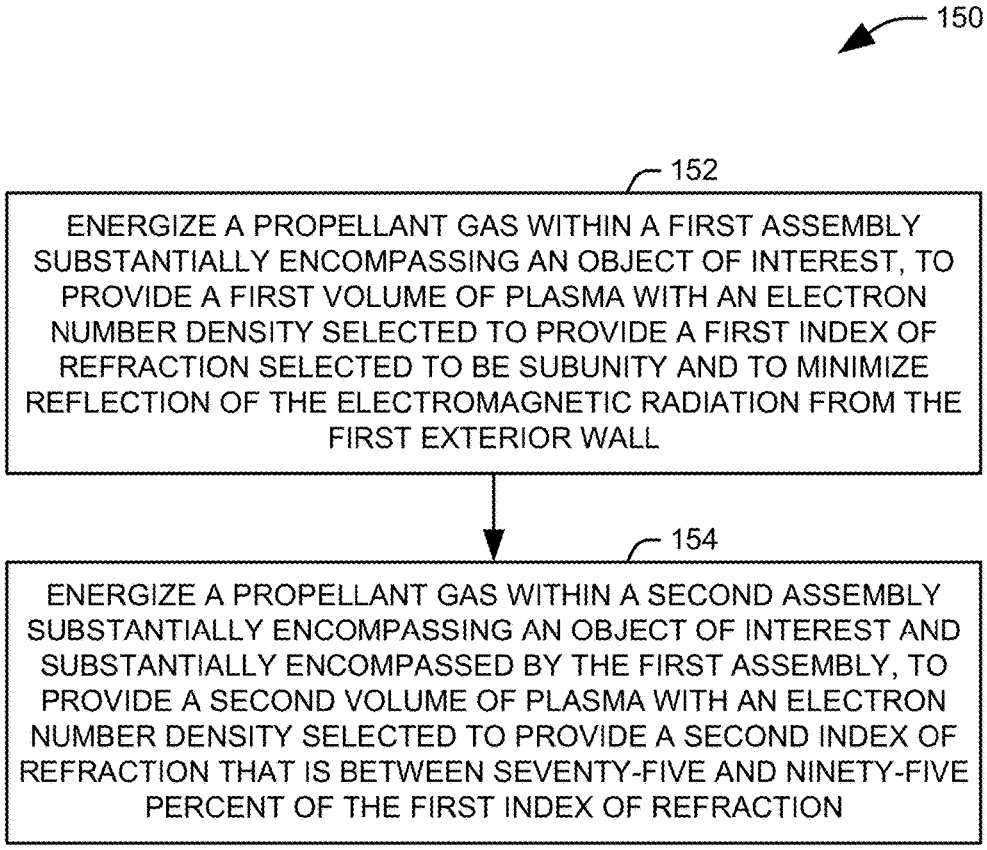
FIG. 4 illustrates a method for redirecting electromagnetic radiation around an object of interest.

In view of the foregoing structural and functional features described above in FIGS. 1-3, example methods will be better appreciated with reference to FIG. 4. While, for purposes of simplicity of explanation, the method of FIG. 4 is shown and described as executing serially, it is to be understood and appreciated that the present invention is not limited by the illustrated order, as some actions could in other examples occur in different orders and/or concurrently from that shown and described herein.

FIG. 4 illustrates an example of a method 150 for redirecting electromagnetic radiation around an object of interest. At 152, a propellant gas within a first assembly, substantially encompassing the object of interest, is energized to provide a first volume of plasma, is energized with an electron number density selected to provide a first index of refraction selected to be subunity. In one implementation, the index of refraction is further selected to minimize reflection of the electromagnetic radiation from the first exterior wall. For example, in an assembly using borosilicate glass walls, the index of refraction could be selected to fall between 0.92 and 0.96.

At 154, a propellant gas within a second assembly, substantially encompassing the object of interest and substantially encompassed by the first assembly, is energized to provide a second volume of plasma with an electron number density selected to provide a second index of refraction that is between seventy-five and ninety-five percent of the first index of refraction. It will be appreciated, however, that a given implementation of the method may use more than two assemblies. In one additional example, a propellant gas within a third assembly, substantially encompassing the object of interest and substantially encompassed by the first assembly and the second assembly, can be energized to provide a third volume of plasma with an electron number density selected to provide a third index of refraction that is between seventy-five and eighty-five percent of the first index of refraction.

In an extension of this example, the second index of refraction can be selected to fall between eighty-five and ninety-five percent of the first index of refraction, and the method can further include energizing a propellant gas within a fourth assembly, substantially encompassed by each of the first assembly, the second assembly, and the third assembly to provide a fourth volume of plasma with an electron number density selected to provide a fourth index of refraction that is between sixty-five and seventy-five percent of the first index of refraction. As is discussed with respect to FIG. 3 above, the inventors have found that the general principles taught herein can be applied to any of a number of layers of plasma, with the index of refraction of an innermost layer of the apparatus decreasing with the number of layers.

The invention has been disclosed illustratively. Accordingly, the terminology employed throughout the disclosure should be read in an exemplary rather than a limiting manner. Although minor modifications of the invention will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

Having described the invention, we claim:

1. A system for redirecting electromagnetic radiation, having a frequency within a frequency band of interest, around an object of interest, the system comprising:

a first assembly, comprising a first interior wall and a first exterior wall enclosing a propellant gas, the first assembly substantially enclosing the object of interest;

a first control system configured to energize the propellant gas within the first assembly to provide a first volume of plasma, such that an electron number density of the first volume of plasma is controlled via the first control system, the electron number density of the first volume of plasma being selected to minimize reflection of the electromagnetic radiation from the first exterior wall;

a second assembly, comprising a second interior wall and a second exterior wall enclosing a propellant gas, the second assembly being positioned as to be substantially concentric with the first assembly and to substantially enclose the object of interest; and a second control system configured to energize the propellant gas within the second assembly to provide a second volume of plasma, such that an electron number density of the second volume of plasma is controlled via the second control system.

2. The system of claim 1, wherein the first control system is configured to energize the propellant gas to provide the electron number density of the first volume of plasma such that an index of refraction of the first volume of plasma at the frequency band of interest is less than one.

3. The system of claim 2, wherein the second assembly is contained within the first assembly and the second control system is configured to energize the propellant gas to provide the electron number density of the second volume of plasma such that an index of refraction of the second volume of plasma at the frequency band of interest is less than the index of refraction of the first volume of plasma at the frequency band of interest.

4. The system of claim 2, wherein the second index of refraction that is between seventy-five and ninety-five percent of the first index of refraction.

5. The system of claim 4, further comprising:

a third assembly, comprising a third interior wall and a third exterior wall enclosing a propellant gas, the third assembly being positioned as to be substantially concentric with the first assembly and the second assembly and to substantially enclose the object of interest; and a third control system configured to energize the propellant gas within the third assembly to provide a third volume of plasma, such that an electron number density of the third volume of plasma is controlled via the third control system to provide a third index of refraction that is between seventy-five and eighty-five percent of the first index of refraction.

6. The system of claim 5, wherein the second index of refraction is between eighty-five and ninety-five percent of the first index of refraction, the system further comprising:

a fourth assembly, comprising a fourth interior wall and a fourth exterior wall enclosing a propellant gas, the fourth assembly being positioned as to be substantially concentric with and enclosed by the first assembly, the second assembly, and the third assembly; and a fourth control system configured to energize the propellant gas within the fourth assembly to provide a fourth volume of plasma, such that an electron number density of the fourth volume of plasma is controlled via the fourth control system to provide a fourth index of refraction that is between sixty-five and seventy-five percent of the first index of refraction.

7. The system of claim 1, wherein the second assembly is immediately adjacent to the first assembly, such that first interior wall and the second exterior wall represent a common structure shared by the two assemblies.

8. The system of claim 1, wherein each of the first exterior wall, the first interior wall, the second exterior wall, and the second interior wall are formed from a dielectric material.

9. The system of claim 8, wherein the dielectric material is glass.

10. The system of claim 9, wherein the electron number density of the first volume of plasma is selected to provide an index of refraction between 0.92-0.96 at the frequency band of interest.

11. The system of claim 1, wherein the first control system comprises a pair of electrodes arranged on the first assembly, the first control system being configured to provide a tunable current across the first pair of electrodes.

12. The system of claim 1, wherein the first control system energizes the propellant gas within the first assembly to provide the first volume of plasma with the electron number density, $n_e$, of the first volume of plasma selected to provide a desired index of refraction at the frequency band of interest, n, such that $$n = \sqrt{1 - \frac{n_e e^2}{(f_c^2 + \omega^2)\varepsilon_0 m_e}},$$

where e is the electron charge, $m_e$ is the electron mass, $f_c$ is the electron-neutral collision frequency, ω is the frequency of the incident wave, and $\in_0$ is the permittivity of free space.

13. A method for redirecting electromagnetic radiation, having a frequency within a frequency band of interest, around an object of interest, the method comprising:

energizing a propellant gas within a first assembly, substantially encompassing the object of interest, to provide a first volume of plasma with an electron number density selected to provide a first index of refraction selected to be subunity; and energizing a propellant gas within a second assembly, substantially encompassing the object of interest and substantially encompassed by the first assembly, to provide a second volume of plasma with an electron number density selected to provide a second index of refraction that is between seventy-five and ninety-five percent of the first index of refraction.

14. The method of claim 13, wherein the first index of refraction is further selected to minimize reflection of the electromagnetic radiation from the first assembly.

15. The method of claim 13, further comprising energizing a propellant gas within a third assembly, substantially encompassing the object of interest and substantially encompassed by the first assembly and the second assembly, to provide a third volume of plasma with an electron number density selected to provide a third index of refraction that is between seventy-five and eighty-five percent of the first index of refraction.

16. The method of claim 15, wherein the second index of refraction is between eighty-five and ninety-five percent of the first index of refraction, the method further comprising energizing a propellant gas within a fourth assembly, substantially encompassed by each of the first assembly, the second assembly, and the third assembly to provide a fourth volume of plasma with an electron number density selected to provide a fourth index of refraction that is between sixty-five and seventy-five percent of the first index of refraction.

17. A system for redirecting electromagnetic radiation, having a frequency within a frequency band of interest, around an object of interest, the system comprising:

a first assembly, comprising a first interior wall and a first exterior wall enclosing a propellant gas, the first assembly substantially enclosing the object of interest;

a first control system configured to energize the propellant gas within the first assembly to provide a first volume of plasma, such that an electron number density of the first volume of plasma is controlled via the first control system, the electron number density of the first volume of plasma being selected to provide a first, subunity index of refraction selected to minimize reflection of the electromagnetic radiation from the first exterior wall;

a second assembly, comprising a second interior wall and a second exterior wall enclosing a propellant gas, the second assembly being positioned as to be substantially concentric with the first assembly and to substantially enclose the object of interest; and a second control system configured to energize the propellant gas within the second assembly to provide a second volume of plasma, such that an electron number density of the second volume of plasma is controlled via the second control system to provide a second index of refraction that is between seventy-five and ninety-five percent of the first index of refraction.

18. The system of claim 17, wherein the second index of refraction is between eighty-five and ninety-five percent of the first index of refraction, the system further comprising:

a third assembly, comprising a third interior wall and a third exterior wall enclosing a propellant gas, the third assembly being positioned as to be substantially concentric with the first assembly and the second assembly and to substantially enclose the object of interest;

a third control system configured to energize the propellant gas within the third assembly to provide a third volume of plasma, such that an electron number density of the third volume of plasma is controlled via the third control system to provide a third index of refraction that is between seventy-five and eighty-five percent of the first index of refraction;

a fourth assembly, comprising a fourth interior wall and a fourth exterior wall enclosing a propellant gas, the fourth assembly being positioned as to be substantially concentric with and enclosed by the first assembly, the second assembly, and the third assembly; and a fourth control system configured to energize the propellant gas within the fourth assembly to provide a fourth volume of plasma, such that an electron number density of the fourth volume of plasma is controlled via the fourth control system to provide a fourth index of refraction that is between sixty-five and seventy-five percent of the first index of refraction.

19. The system of claim 17, wherein each of the first exterior wall, the first interior wall, the second exterior wall, and the second interior wall are formed from borosilicate glass.

20. The system of claim 19, wherein the electron number density of the first volume of plasma is selected to provide an index of refraction between 0.92-0.96 at the frequency band of interest.

* * * * *